United States Patent [19]

Barker et al.

[11] Patent Number: 4,762,067

[45] Date of Patent: Aug. 9, 1988

[54] DOWNHOLE PERFORATING METHOD AND APPARATUS USING SECONDARY EXPLOSIVE DETONATORS

[75] Inventors: James M. Barker, Katy; Larry L. Grigar, East Bernard; Dennis E. Schramek, Houston; Starlin M. Reid, Katy; Cyril R. Sumner, Houston, all of Tex.

[73] Assignee: Halliburton Company, Duncan, Okla.

[21] Appl. No.: 120,275

[22] Filed: Nov. 13, 1987

[51] Int. Cl.[4] ..... F42B 1/02

[52] U.S. Cl. ..... 102/313; 102/312; 102/202.4; 102/202.7; 102/202.8; 102/202.14; 102/275.5; 102/275.6; 102/275.11

[58] Field of Search ..... 102/312, 313, 202.4, 102/202.7, 202.8, 202.14, 275.5, 275.6, 275.11

[56] References Cited

U.S. PATENT DOCUMENTS

| | | | |
|---|---|---|---|
| 4,307,663 | 12/1981 | Stonestrom | 102/202.4 |
| 4,422,381 | 12/1983 | Barrett | 102/202.2 |
| 4,592,280 | 6/1986 | Shores | 102/202.2 |
| 4,602,565 | 7/1986 | MacDonald et al. | 102/202.7 |
| 4,632,034 | 12/1986 | Colle, Jr. | 102/312 |
| 4,662,281 | 5/1987 | Wilhelm et al. | 102/494 |
| 4,716,832 | 1/1988 | Sumner | 102/275.6 |

*Primary Examiner*—Peter A. Nelson
*Attorney, Agent, or Firm*—William J. Beard

[57] ABSTRACT

For use in a perforating gun assembly, a perforating gun detonator is disclosed. One embodiment is hermetically sealed while the other has openings therein to admit well fluids. In both embodiments, a narrow conductive metal foil is provided with a current to vaporize the narrow foil, explode the foil and propel a flyer driven by a shock wave for detonation of a spaced secondary explosive. The explosive then couples explosion into a detonating cord against a shoulder in a housing adjacent to the secondary explosive. The current is formed by means of an AC voltage multiplier circuit providing a charge on a capacitor which is discharged through a spark gap. Charging circuitry includes a blocking capacitor to prevent DC and a resistor for bleeding a small current from the capacitor to ground which prevents static or stray current accumulation.

23 Claims, 2 Drawing Sheets

DOWNHOLE PERFORATING METHOD AND APPARATUS USING SECONDARY EXPLOSIVE DETONATORS

BACKGROUND OF THE DISCLOSURE

After a well borehole has been drilled to a specified depth, a perforating shaped charge is used to form a jet perforation extending radially outwardly which punctures casing in the well, cement on the exterior and adjacent formations with the view of initiating fluid flow from the formation of interest. It is an important sequential step, which if misfired, creates a great deal of risk in the well completion procedures.

A typical procedure is to support an assembly on a wireline which incorporates one or more (typically several) jet perforating shaped charges. A detonator is included to trigger operation of the various shaped charges. In one approach, the shaped charges are supported on an open carrier which has the form of a lengthwise metallic strip or the like. The shaped charges are exposed to well fluids. A detonator supported on the carrier is also exposed to the well fluids and must operate with impunity to the surrounding environment. The detonator (sometimes called a blasting cap) starts detonation at one end of a detonating cord which extends the length of the apparatus. The resulting shock wave formed by the detonator travels along the cord and initiates the multiple attached shaped charges to perforate the well. The detonator is ordinarily constructed of a primary explosive material. The terms "primary" and "secondary" refer to the relative sensitivity of explosive materials. A typical primary explosive material is lead azide, and another is lead styphnate. Such primary explosive materials are normally extremely sensitive to any stimuli, including heat, sparks, friction, shock, and electrical current. To the measure that they are somewhat sensitive to various stimuli, a safety hazard is created in light of the fact that any stimuli may trigger premature detonation. This type of sensitivity associated with well known primary explosives shows them to be sensitive to premature or unintended shock, static electricity discharge, high ambient temperature normally associated with downhole conditions and other causes of detonation. For instance, electromagnetic radiation is a serious factor including RF (Radio Frequency) radiation at any wave length. Electrical static and mechanical agitation can also cause premature triggering. Detonation may occur at the wrong depth in the well and place the perforations at the wrong location. It may also occur near the well head, and possibly injure personnel near the well head.

The term "secondary explosive" refers to explosive materials which are not as sensitive as primary explosive materials. Typical examples of secondary explosives are RDX, HNS, PYX and others. In general terms, they are much more stable for handling and are relatively insensitive to detonation initiation. This lack of sensitivity makes them much safer to use. They are much safer to handle and are not as likely to explode prematurely. Secondary explosive detonators are much safer from inadvertent operation. In fact, they are so difficult to detonate that it requires special effort to provide proper detonation shock. In detonators made of primary explosives, the current for detonation is typically less than one ampere. This is so small as to run the risk of detonation with stray currents in the firing circuit. This also suggests that these detonators are sensitive to heat, impact, and unintended static discharge. With a secondary explosive, a significantly greater current flow (or other external stimuli) is required for detonation.

The present invention sets forth a means and method of detonating secondary explosives in a detonator which particularly protects against unintended stray currents, static electricity discharges, and the like. It also protects against RF detonation. It additionally protects against unintended shock detonation. The present apparatus contemplates the use of an electrically operated detonator which is provided with a sizable current over a long interval of time. While it is possible for a static discharge to ignite a secondary explosive, it is highly unlikely. Secondary explosives in the detonator inevitably require a much larger electric current for initiation. The present apparatus incorporates a system whereby a large AC current is applied through a wireline to a circuit which forms a proper detonation signal. The signal is delivered in the form of AC current flow which is stored on a charging capacitor through a voltage multiplying circuit. Only when the current forms an adequate charge is the capacitor able to form a discharge ideally through a gas discharge tube, or spark gap. This circuit cooperatively yields a charging sequence which forms an adequate charge, a charge having a voltage exceeding a required minimum and sustains the current on discharge for at least a specified interval. The circuit protects against stray or static discharges. Static which occurs in random fashion may create a momentary charge on the capacitor but that is reduced to zero by a bleed circuit incorporating a resistor connected to ground. As the circuit operates protectively, no preliminary inadvertent triggering event can occur whereby premature detonation occurs. Thus, the safer secondary explosives used in the detonator are much more difficult to detonate but this is used to advantage to assure that random events do not trigger detonation.

The present apparatus further incorporates an exploding wire foil and flyer combination for forming the necessary shock. The exploding wire foil is connected across the electrical circuit which forms the requisite output current. The output current must have a substantial current flow for a minimum interval. It flows through a wire foil which has a narrow neck. In the region of the neck, the current typically vaporizes that portion of the wire foil. When this occurs, the wire foil is exploded. It is arranged so that the foil explosion shears a small disc, called a flyer, which traverses a specified distance to impinge on secondary explosive materials and thereby initiate explosion. This distance is important in providing a safety interlock in the present apparatus. The value of this will be understood on description of the problem set forth below.

The present apparatus is particularly useful in a sealed housing which encloses a set of shaped charges. The sealed container is intended to be leakproof and is constructed in this fashion. It is impossible to know whether it does leak when downhole. When leakage occurs, the leakage will fill the lower part of the closed and sealed housing. When sequential detonation of the shaped charges is started, pressures within the housing rise rapidly. When a noncompressible fluid, partially or wholly, fills the housing, the case will quickly split resulting in destruction of the entire structure and may very well abort the perforating sequence. When this occurs, it may be impossible to retrieve the shattered tool and other equipment on the wireline. It is difficult to know how many of the perforations will be formed. The present detonator is a detonator adapted to be installed at the lower end of the tool. If there is no leakage, there is no fluid in the lower portion of the tool and detonation is triggered through the detonator which sets off the explosive sequence in a detonating cord propagated to the several shaped charges. By contrast, assume that leakage has occurred and that the detonator is then submerged in well fluids. The detonator of the present apparatus is constructed so that well fluids in the tool will prevent electrical firing. First of all, the circuit which provides the necessary current flow to the exploding wire foil has exposed terminals which are fluid shorted to thereby prevent detonation. In addition, the fluid which accumulates in the tool is permitted to come into the detonator to fill the gap between the exploding wire foil and the secondary explosive. This prevents detonation. At the surface, when this occurs, operating personnel will have sufficient information to know that the explosive sequence has not occurred and that the detonator has been prevented from firing. This also enables the entire structure to be retrieved. It is retrieved in an armed, but completely safe, condition since the detonator has been properly prevented from operation by means of the fluid accumulation in the tool.

The present apparatus provides an alternate detonator which has sealed electrical leads. Thus, it can be used fully submerged in well fluids and yet still operate. This particular version of the detonator is desirable when used with perforating shaped charges that are not enclosed in a sealed housing. These are known as "exposed" perforating guns, and any detonator used with them must be fluid tight.

The alternate apparatus similarly contemplates the use of the firing circuit which is an AC Voltage multiplier having a ladder circuit accumulating an increased charge on a charging capacitor. A bleed resistor to ground is included to prevent accumulation of stray or static events. Moreover, the output is through a pair of terminals which are controllably exposed to well fluids. These terminals in turn connect to an exploding wire foil which has the shape of an hourglass so that the narrow portion literally explodes when the current flow is directed through the narrow neck. The exploding wire foil shears a flying disc which is in spaced relationship to a secondary explosive charge. Initiation of the explosive is prompted by impact of the flying disc. The foil end flyer combination is included within a housing which has an internal shoulder abutting the detonating cord so that it is prevented from pumping into the housing by ambient pressure conditions. The housing is sealed at respective spaced ends by means of tapered boots fitting over the exterior. The explosives in the detonator are only secondary explosives thereby providing a significantly safer detonating system.

DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
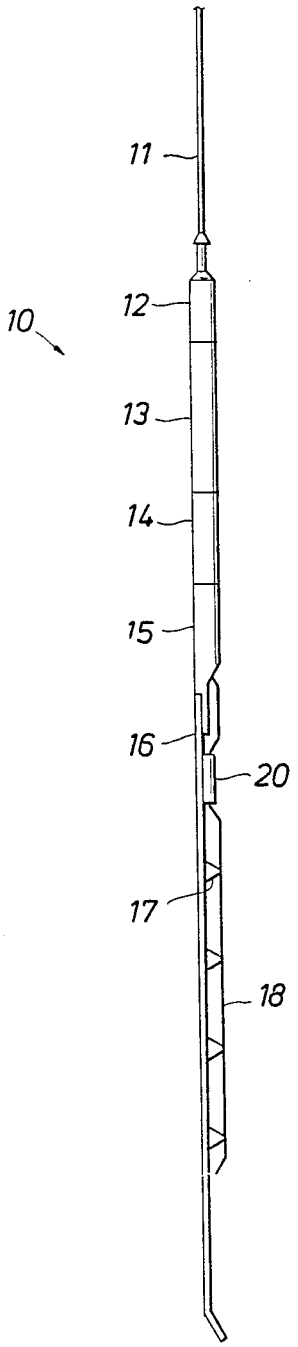
FIG. 1 shows a shaped charge carrier incorporating a detonator in accordance with the present invention operated by the charging circuit to be described.

Attention is first directed to FIG. 1 of the drawings where the numeral 10 identifies a perforating gun assembly adapted to be lowered in a well for conducting perforating operations with shaped charges. This includes a wireline 11 of substantial length which includes a current conducting member as well as a strength member. The wireline 11 is connected to a cable head 12. In turn, that is connected with a collar locator 13. The collar locator 13 locates collars in the casing and thereby provides an electrical signal of the location of the shaped charge perforating gun assembly 10 to the surface to enable proper positioning of the apparatus in the borehole. A casing collar locator is well known in the art. The apparatus further includes a firing sub 14 connected below the collar locator 13 and in turn that is connected with a firing head 15. The firing sub and firing head combination incorporates the circuitry to be described in conjunction with FIG. 3 of the drawings. The system further includes an elongate carrier member 16 which supports a number of shaped charges 17 therealong. The several shaped charges are all detonated by means of an explosive signal provided over a detonating cord 18. The detonating cord is initiated with a detonating signal from a detonator 20. The several shaped charges are fired to form perforations through the surrounding casing and into the adjacent formations.

Figure 2:
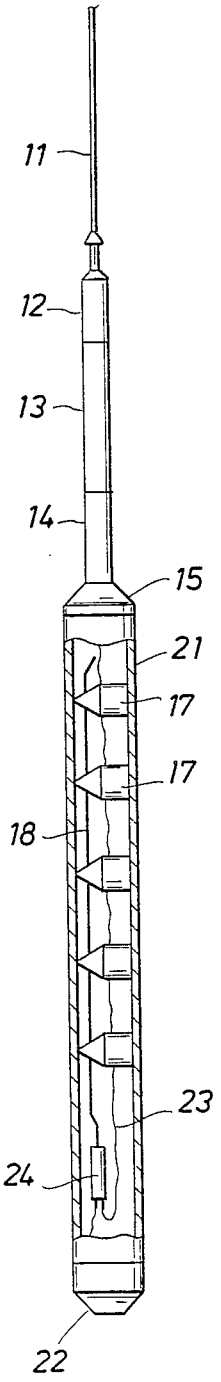
FIG. 2 is a shaped charge carrier similar to that of FIG. 1 wherein the shaped charges are enclosed in a sealed housing to exclude well fluids and further including a detonator located at the lower portion of the sealed housing.

FIG. 2 is a structure similar to that of FIG. 1 except in certain details as will be noted. To this end, a similar wireline 11 is shown in FIG. 2 and connects with similar cable head 12 and a similar collar locator 13. The arrangement shown in FIG. 2 also includes a firing sub 14 which is connected with a firing head 15. Rather than a carrier, this arrangement of apparatus utilizes an elongate cylindrical sealed housing 21 which is closed with a bull plug 22 at the lower end. The several detonating cord, which in turn detonates the shaped charges 17 are again included and are detonated for forming perforations by a detonator cord 18. In this arrangement, the detonator is located at the lower end. A wire 23 provides an electrical current flow to the detonator 24. The detonator 24 triggers the shaped charges for operation from bottom to top. The detonator 24 is located at the lower end of the tool for reasons to be described. The detonators 20 and 24 are shown in the accompanying drawings and will be described beginning with FIG. 3 where the detonator 24 is illustrated.

Figures 3, 4, 5:
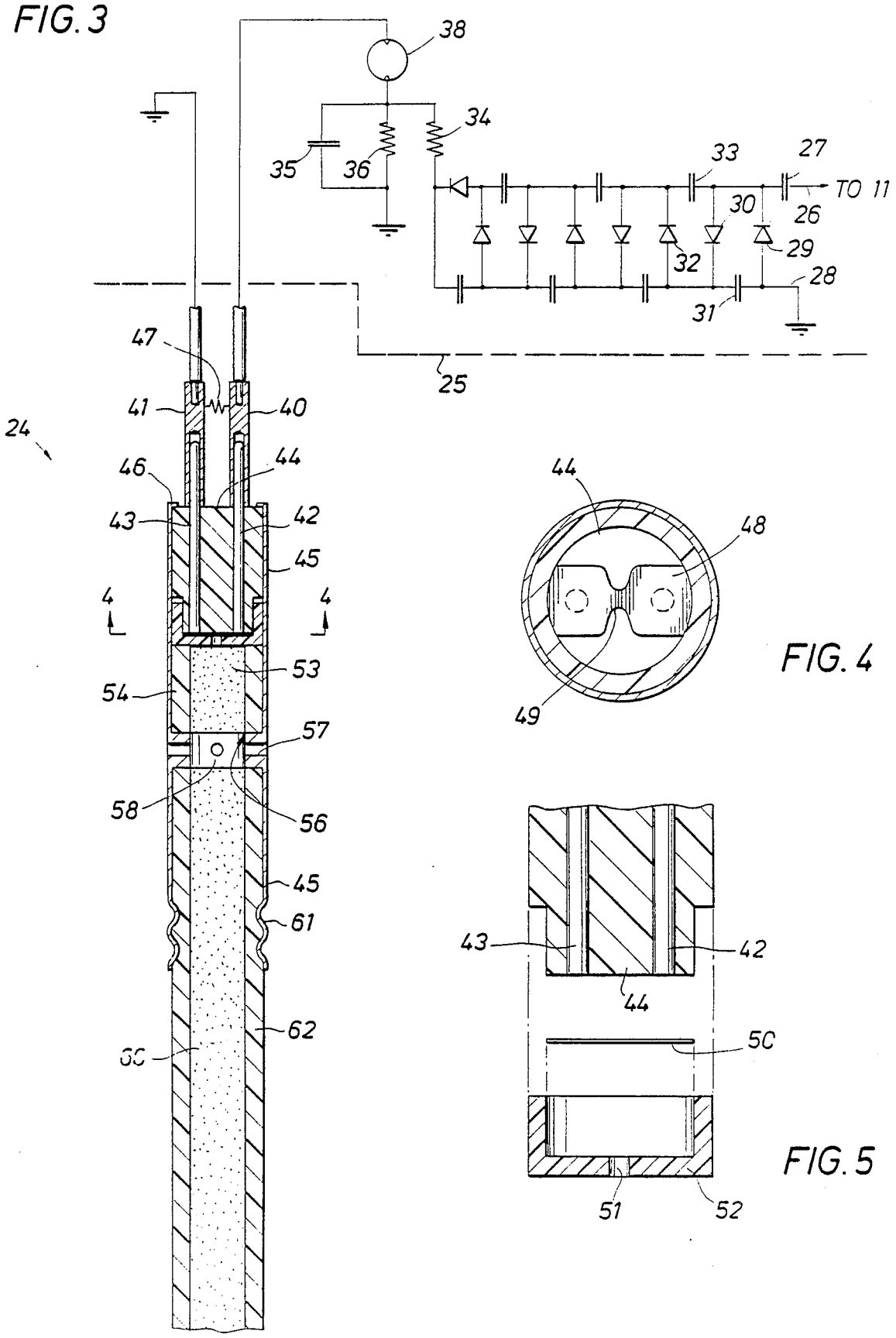
FIG. 3 shows a firing circuit connected to a cooperative detonator having an exploding foil element and including a space wherein well fluids may enter to prevent detonation.
FIG. 4 is a sectional view along the line 4—4 of FIG. 3 showing the shape of the exploding wire foil.
FIG. 5 is an exploded view of the components including the exploding wire foil.

Attention is now directed to FIG. 3 of the drawings where the numeral 24 identifies the detonator that is adapted to be used as a fluid-disabled device. Moreover, FIG. 3 also illustrates a firing circuit generally identified at 25 which is physically located in the firing sub 13. The circuit includes a conductor 26 which extends to the wireline 11 for receiving current flow from the surface. The circuit incorporates the following significant structural elements. The conductor 26 is the input conductor to a blocking capacitor 27. This prevents DC from feeding through the circuit. In like fashion, there is a suitable ground connection indicated at 28. The input AC signal is applied to a ladder circuit including reversed diodes 29 and 30 which connect to a capacitor 31. This is repeated successively by incorporation of the additional diode 32 which is connected across the capacitor 33 in the same fashion as the capacitor 31. This sequence is repeated where the diodes alternate direction and the respective capacitors 31 and 33 are duplicated along the ladder. The number of diodes and capacitors in the ladder can be increased. The various capacitors are preferably fabricated with equal peak voltages and equal capacitance. The ladder circuit forms a high voltage rectified current which flows through a connecting resistor 34 to charge a capacitor 35 connected to ground. Charge on the capacitor 35 is accumulated by application of AC current for several seconds. The charge on the capacitor 35 is reduced continuously by means of a bleed resistor 36 connected to ground.

Assume that stray or random static events occur. For instance, assume that a very large voltage spike passes through the circuitry. Even assuming that it is a very large voltage level, because it is not repeated, it will not form the necessary charge accumulation on the capacitor 35. The capacitor 35 does not change voltage instantaneously so that no output firing signal can be formed. Assume that a leakage current exists somewhere in the system. While the charge on the capacitor might otherwise accumulate, any leakage current is reduced by bleeding to ground through the resistor 36. Therefore, long term leakage currents and short term voltage spikes can not provide a triggering event to the system whereby the detonator is discharged. The charge capacitor 35 accumulates the needed large charge from AC current applied to the voltage ladder. This large current forms a significant charge accumulation which is finally sufficient to operate the voltage discharge tube 38. When this occurs, a very substantial current flow is delivered to the detonator 24 and operation is then assured. An important factor is that the voltage be sufficiently high and the current have sufficient duration to trigger proper operation. The spark gap tube 38 is a gas filled tube which does not conduct unless a particular voltage level across the tube is experienced whereupon a current surge does then occur. At this time, the current surge is sufficient to trigger operation of the detonator. It is desirable to locate the spark gap tube 38 as close as reasonably possible to the detonator which is connected to it.

The voltage which triggers the detonator is delivered over a conductor and provided to an electrical lead 40. A similar ground lead 41 is likewise included to complete the circuit. The leads 40 and 41 secure aligned voltage conductor pins 42 and 43. They extend through a sealed body 44 which is surrounded by a shell or housing 45. The housing is crimped or rolled at the end 46 to fasten the housing around the base 44. The leads 40 and 41 are adapted to be exposed to well fluids. Well fluids are conductive at least to some measure. In effect, well fluid contact with the leads 40 and 41 forms an equivalent resistor 47 across the leads 40 and 41. The resistor 47 is equivalent to the fluid contact resistance. In other words, fluid which surrounds the pins 40 and 41 has an equivalent resistance. This resistance is sufficient to reduce firing current applied to the system as will be described.

The base 44 is drilled with a pair of holes which position the pins 42 and 43. The pins extend fully through the base. The base 44 is shown in FIG. 4 in the end view after disassembly to expose the end of the base. A metal foil 48 is placed across the circular end face of the base. It extends across and contacts against the ends of the pins 42 and 43. The foil 48 is shaped with a narrow neck 49, the neck 49 being in the form or shape of an hour glass. The neck 49 is a narrower region which is centered on the circular support surface. The metal foil is made of conductive material, copper being a suitable material. It is relatively thin and measures less than 0.001 inches in thickness. The narrow neck 49 is reduced by perhaps seventy-five percent of the width of the foil strip 48. This reduction in width assures that the current flow between the two pins is constrained in the region of the neck. This deployment of components directs the current flow through the hour glass shape at 49 and thereby assures that the foil is exploded by the current flow. Going now to FIG. 5 of the drawings, the numeral 50 identifies a thin sheet plastic disc which is placed over the foil. The disc 50 is quite thin, perhaps 0.001 inches in thickness. It is made of plastic but it can be made of other non-conductive materials also. Primarily, it is included to form a flyer disc which travels through an opening 51 in a cap 52 fitted over the exploding wire foil 48 shown in FIG. 4. The vaporization of the foil 48 is so violent that a divit is sheared out of the disc 50 and is propelled violently through the passage 51. The flyer drives into the secondary explosive 53. This cylindrical plug of explosive material is detonated by the impact of the flyer driven by the exploding wire foil.

The secondary explosive material is captured in a sleeve 54. In turn, the sleeve 54 is on the interior of the housing 45. The housing has an internal shoulder at 56 which is abutted against the secondary explosive charge 53 to fasten that charge and prevent movement. The housing is drilled with a number of ports 57. The ports 57 introduce well fluid into a chamber 58. The chamber 58 is filled with well fluid should any be in the near vicinity. Fluid disrupts the secondary explosive charge 53 from transferring detonation to a detonating cord 60 located an appropriate distance away.

The shoulder 56 on the interior of the housing 45 contacts and abuts against a detonating cord 60. The cord is prevented from further entry by the internally directed shoulder 56. The housing 45 is serrated with a crimp at 61 that grips the jacket 62 around the detonating cord 60 to assure sound mechanical connection. It prevents the detonating cord 60 from pulling free. The detonator as described and illustrated in FIG. 3 is thus an apparatus which is able to provide detonation to the detonating cord 60 only if proper fluid isolation has occurred.

Recall that the detonator 24 is installed within the sealed housing 21. If no fluid leaks into the immediate vicinity of the detonator 24, then detonation will occur in the ordinary fashion. That is, the electric current will be applied to the foil 48 which will be vaporized almost in an instant. This is particularly concentrated at the neck 49. The disc 50 is sheared to form a flyer that impacts against the secondary explosive plug. The flyer impact is sufficient to ordinarily obtain detonation.

If well fluids leak into the sealed housing, they provide an equivalent resistor 47 which reduces the current flow. It may very well sufficiently reduce current flow to completely avoid detonation of the secondary explosive 53. Moreover, while fluid is admitted to the area around the pins and provides electrical shorting, such fluid is also admitted between the secondary explosive 53 and the detonating cord 60. It fills, at least in some measure, the chamber 58 and prevents the detonating signal from properly triggering operation of the cord 60. This provides two methods of defeating operation of the detonator in the circumstances described with respect to the closed housing assembly shown in FIG. 2. A third method also is possible since fluid may fill the hole 51 and thus disrupt the flyer's pathway.

Figure 6:
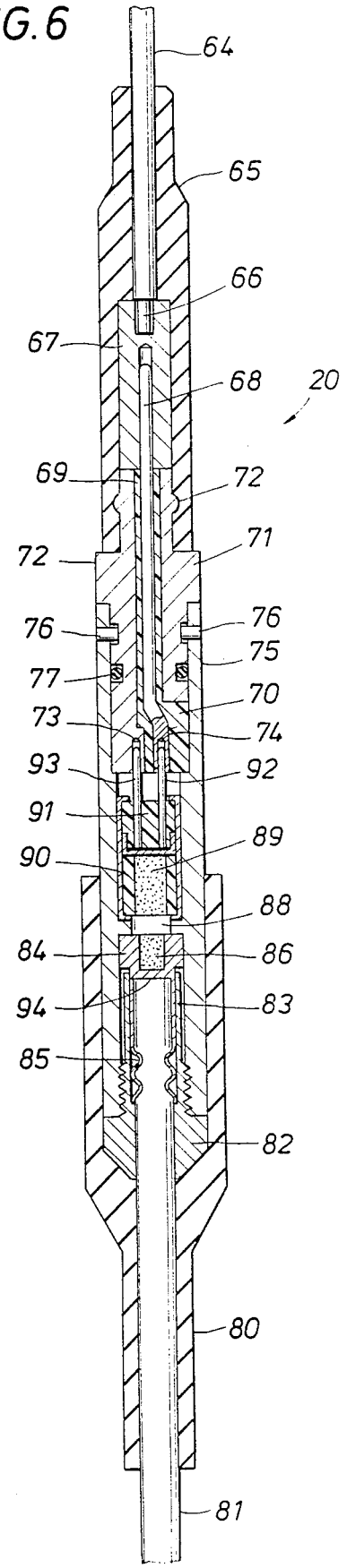
FIG. 6 is an alternative embodiment of the detonator which is designed to exclude entry of well fluids and further incorporating means connecting with the detonating cord.

FIG. 6 shows the detonator 20. The numeral 64 identifies an insulated electrical conductor which is received through a boot 65 at the left hand end of the detonator assembly. This connects with the exposed wire tip 66 from the conductor 64 which is connected with a feedthrough fitting 67. In turn, that connects with a pin 68 serving as an electrical conductor. It is received on the interior of an insulative sleeve 69 which surrounds the pin 68. The insulative sleeve extends the full length of the pin 68. The insulating sleeve is shaped into a surrounding head portion 70. The head portion 70 is constructed integrally within a body portion 71, the body portion abutting the boot 65. The body portion is constructed with a surrounding bead 72 which assists in engaging the boot 65. The body portion 71 is made of conductive material and has an exposed area 72 which serves as a ground return for completion of the electrical circuit necessary for operation. The body 71 thus provides a ground return path and to this end, has s hole 73 formed therein for a ground connection. In similar fashion, the pin 68 is drilled at the end to define a mating hole at 74.

The body portion 71 is joined to a surrounding housing 75. It is joined to the body by suitable pins 76 inserted at spaced locations around the exterior. Fluid leakage is prevented through this connection by incorporation of an O-ring seal 77.

The surrounding external housing 75 is fairly long and extends up into a similar boot 80. The boot 80 is fitted around a detonating cord 81. It grips the detonating cord and protects the various components on the interior. The boot 80 surrounds an internal retaining ring 82 which slips over the detonating cord, and which has an upstanding tubular sleeve portion 83. The sleeve 83 is on the interior of the housing 75 and extends over a portion of an internal alignment sleeve 84. The sleeve 84 is on the centerline of the apparatus. The sleeve 84 is preferably roll crimped at 85. This fastens around the end of the detonating cord 81. This assures a fastened and fixed end supporting shoulder abutting the detonating cord. The sleeve is axially hollow and encloses a charge of explosive material identified at 86. It is locked in position by means of an internally directed shoulder immediately adjacent to an air gap 88.

The gap 88 is immediately adjacent to an explosive charge 89 which is received within a surrounding supportive sleeve 90, the sleeve 90 being positioned adjacent to a pin guide 91. The pin guide 91 supports a pair of pins 92 and 93 which are connected in the sockets at 73 and 74. The pins extend through the guide 91. The pins contact against a wire foil of the same type shown in FIG. 4 adjacent to a disc of the same sort shown in FIG. 5. In other words, the exploding wire foil is again implemented in the detonator 20 in the same fashion as in the embodiment 24 previously described.

This apparatus 20 is hermetically sealed. The boots 65 and 80 seal around the ends to prevent fluid intrusion. The outer housing 75 encompasses the various components on the interior which are received within sealed chambers for operation. The exploding wire foil operates in the same fashion to trigger or detonate the explosive material 89, a shock wave then traverses the air gap 88 to detonate the explosive 86 and thereby provide transfer thru through the barrier 94 to the cord 81. The barrier 94 prevents the detonating cord from moving into the housing 75 due to hydraulic pressure acting on the cord. In this fashion, detonation of the device 20 is accomplished in the same manner as in device 24. An important and primary difference is that the structure is a sealed structure. Both detonators however are provided with shoulders which abut the end of the detonating cord. Moreover, rolled crimps are included to fasten the ends of the detonating cords. The electrical connections are made through pins which are supported in rigid housings, and suitable complete electrical circuits are constructed for exploding the wire foil as shown in FIG. 4.

While the foregoing sets out preferred embodiments of the present apparatus and methods of operation, the scope is determined by the claims which follow:

What is claimed is:

1. A detonator for use in a well borehole for detonating explosives, comprising:

(a) conductive metal foil sized and shaped to conduct current therethrough wherein said foil, on current flow in excess of a specified level forms a detonating shock wave;

(b) secondary explosive charge means;

(c) housing means supporting said foil to form a shock wave from said foil toward said charge means to impinge thereon for detonation of said charge means; and (d) a detonating cord fixedly supported by said housing means and in sufficient proximity to said charge means to serially detonate said detonating cord from said charge means.

2. The apparatus of claim 1 wherein current conducting means delivers a current flow in excess of a specified energy level to vaporize a portion of said foil.

3. The apparatus of claim 2 wherein said foil has a wider portion and a comparatively narrow portion and the narrow portion is vaporized by the electric current.

4. The apparatus of claim 1 wherein said housing means incorporates a passage therein for directing the flyer driven by the shock wave from said foil toward said charge means spaced therefrom.

5. The apparatus of claim 1 including externally located boot means enclosing said housing means to exclude entry of external fluid thereinto.

6. The apparatus of claim 1 wherein said housing means includes wall means supporting said charge means spaced from said foil, and holes formed in said wall means to admit well fluid into the space between said charge means and said foil.

7. The apparatus of claim 1 including first and second cooperative current carrying conductors extending into said housing means wherein said conductors are exposed to be shorted by well fluids in the vicinity of said housing means.

8. The apparatus of claim 1 including an internally located shoulder abutting the end of said detonating cord to fix said detonating cord in said housing means against movement.

9. The apparatus of claim 8 including a fastening crimp between said detonating cord and a surrounding fixed sleeve to secure said detonating cord in location.

10. For use with a detonator connected to detonate explosives in a well borehole apparatus, an electrical impulse circuit comprising:

(a) output means for connection to an electrically operated detonator;

(b) current forming means forming a current pulse flowing from said output means wherein the current is (1) in excess of a specified level;

(2) exceeds a specified duration; and (3) substantially uninterrupted;

(c) static grounding means for preventing static current flow from said output means; and (d) AC current input means said current forming means for controlling operation thereof.

11. The impulse circuit of claim 10 wherein said output means includes current blocking means rendered conductive only in the event of applying a voltage thereto in excess of a required level.

12. The apparatus of claim 11 further including a grounded resistor parallel to said current forming mesns for continuously bleeding to ground any charge which might accumulate thereon.

13. The apparatus of claim 10 wherein said static grounding means connects to an input voltage multiplying ladder means providing charge to be stored on a storage capacitor incorporated in said current forming means, and wherein charge is accumulated on said capacitor.

14. The apparatus of claim 13 wherein said ladder means connects with said AC current input means, and includes a DC blocking capacitor.

15. The apparatus of claim 14 further including a grounded resistor connected across said storage capacitor.

16. The apparatus of claim 15 further including a spark gap connected to said output means for providing current flow thereto when the charge on said storage capacitor exceeds the level triggering operation of said spark gap.

17. The apparatus of claim 10 wherein said circuit means is connected to receive AC current flow through a wireline suspendable in a well borehole, and said output means connects with a detonator for detonation of shaped charges in a perforating gun assembly.

18. A method of controllably detonating a detonator in a well borehole, comprising the steps of:

(a) placing a current conductive wireline in a borehole;

(b) conducting AC current along the wireline for a specified time;

(c) charging a capacitor with current received through the wireline;

(d) increasing the voltage as charge is accumuleted across the capacitor until a specified voltage is achieved;

(e) dumping charge from the storage capacity at a specified minimum current and for a specified minimum interval; and (f) wherein the current from the capacitor creates an impacting flyer for detonation of a detonator in the well borehole.

19. The method of claim 18 including the step of applying an AC voltage on the wireline and multiplying that voltage to achieve a specified maximum voltage for forming a charge on the storage capacitor.

20. The method of claim 18 further including the step of blocking static voltage spikes from the storage capacitor.

21. The method of claim 18 including the step of continuously bleeding charge from said storage capacitor at a minimal rate to prevent long term charge accumulation.

22. The method of claim 18 wherein the current is applied to a foil to create a flyer from an insulating disc for detonation.

23. The method of claim 18 wherein the current is directed through a conductive metal foil of limited cross-sectional area and the current is sufficient that the foil in the cross-section is heated to vaporization.

* * * * *